US010203177B2

(12) United States Patent
Chavez

(10) Patent No.: US 10,203,177 B2
(45) Date of Patent: Feb. 12, 2019

(54) MAGAZINE INSERTION GUIDE

(71) Applicant: Adrian Chavez, Las Vegas, NV (US)

(72) Inventor: Adrian Chavez, Las Vegas, NV (US)

(73) Assignee: SALIENT ARMS INTERNATIONAL, Las Vegas, NV (US)

( * ) Notice: Subject to any disclaimer, the term of this patent is extended or adjusted under 35 U.S.C. 154(b) by 0 days.

(21) Appl. No.: 15/406,335

(22) Filed: Jan. 13, 2017

(65) Prior Publication Data

US 2017/0205188 A1 Jul. 20, 2017

Related U.S. Application Data

(60) Provisional application No. 62/278,808, filed on Jan. 14, 2016.

(51) Int. Cl.
*F41C 23/10* (2006.01)
*F41A 9/65* (2006.01)

(52) U.S. Cl.
CPC ..... *F41C 23/10* (2013.01); *F41A 9/65* (2013.01)

(58) Field of Classification Search
CPC ..... F41C 23/00; F41C 23/10; F41A 9/65
USPC ..... 42/71.02
See application file for complete search history.

(56) References Cited

U.S. PATENT DOCUMENTS 4,520,585 A * 6/1985 Barrett ..... F41C 23/10 42/7
5,052,140 A * 10/1991 Smith ..... F41C 23/10 42/7
8,156,677 B2 * 4/2012 Glock ..... F41A 11/02 42/71.01

FOREIGN PATENT DOCUMENTS

AT 508316 A1 * 12/2017

* cited by examiner

*Primary Examiner* — Stephen Johnson
(74) *Attorney, Agent, or Firm* — Wolfe-SBMC

(57) ABSTRACT

A magazine insertion guide is described. In one example, the magazine insertion guide includes a securing portion configured to be secured to a pistol grip of a firearm and a guide portion. The guide portion includes ramped internal surfaces configured to guide insertion of a magazine into an interior of the pistol grip of the firearm and a plurality of sides that are configured to at least partially surround the pistol grip of the firearm and has an opening configured to permit installation and removal of a plurality of different sized backstraps when the securing portion is secured to the pistol grip of the firearm and without removal of the securing portion.

20 Claims, 18 Drawing Sheets

MAGAZINE INSERTION GUIDE

RELATED APPLICATIONS

This Application claims priority under 35 U.S.C. Section 119(e) to U.S. Provisional Patent Application No. 62/278,808, filed Jan. 14, 2016, titled "Magazine Insertion Guide" to Adrian Chavez, the entire disclosure of which is hereby incorporated by reference.

BACKGROUND

Magazine insertions guides have found success in firearm competitions that involve quick changing of a magazine of the firearm (e.g., pistol) to enable this operation to be performed in a faster manner. Conventional magazine insertion guides, however, are bulky and thus limited to use in competition. Further, these conventional guides are limited to use by specific firearms, and even specific firearm/backstrap combinations for those firearms that support changeable backstraps to vary a grip diameter of a pistol grip, thus requiring multiple guides for even a single style of grip for each type of firearm.

SUMMARY

A magazine insertion guide is described. In one example, the magazine insertion guide includes a securing portion configured to be secured to a pistol grip of a firearm and a guide portion. The guide portion includes ramped internal surfaces configured to guide insertion of a magazine into an interior of the pistol grip of the firearm and a plurality of sides that are configured to at least partially surround the pistol grip of the firearm and has an opening configured to permit installation and removal of a plurality of different sized backstraps when the securing portion is secured to the pistol grip of the firearm and without removal of the securing portion.

In another example, a system includes a firearm, a plurality of backstraps having different sizes, one to another, to support use by different sized hands of a user when attached to a pistol grip of the firearm, and a magazine insertion guide. The magazine insertion guide has a securing portion that is configured to be secured to the pistol grip and a guide portion including ramped internal surfaces configured to guide insertion of a magazine into an interior of the grip of the firearm and a plurality of sides that are configured to at least partially surround the pistol grip of the firearm and has an opening configured to permit installation and removal of a plurality of different sized backstraps when the securing portion is secured to the pistol grip of the firearm and without removal of the securing portion.

In a further example, backstraps are changed on a pistol grip of a firearm without removing a magazine insertion guide. A magazine insertion guide is attached to a pistol grip of a firearm. A first backstrap is removed from the pistol grip of the firearm without removing the attached magazine insertion guide from the pistol grip. After the first backstrap is removed, a second backstrap is attached to the pistol grip of the firearm without removing the attached magazine insertion guide from the pistol grip.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

FIG. 1F depicts a rear view of the magazine insertion guide.

DETAILED DESCRIPTION

Figure 1A:
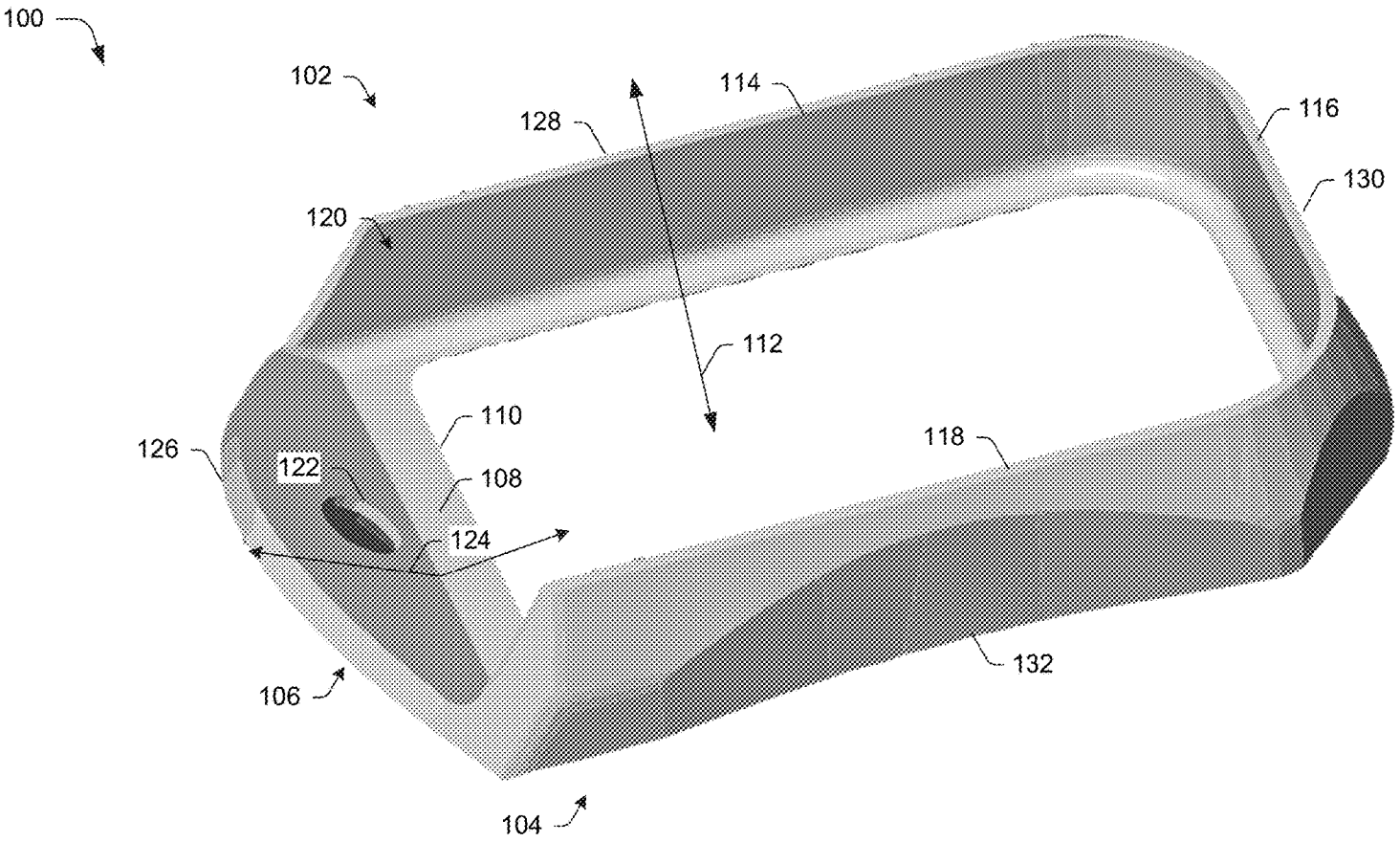
FIG. 1A depicts an isometric view from a rearward side of a magazine insertion guide.
Figure 1B:
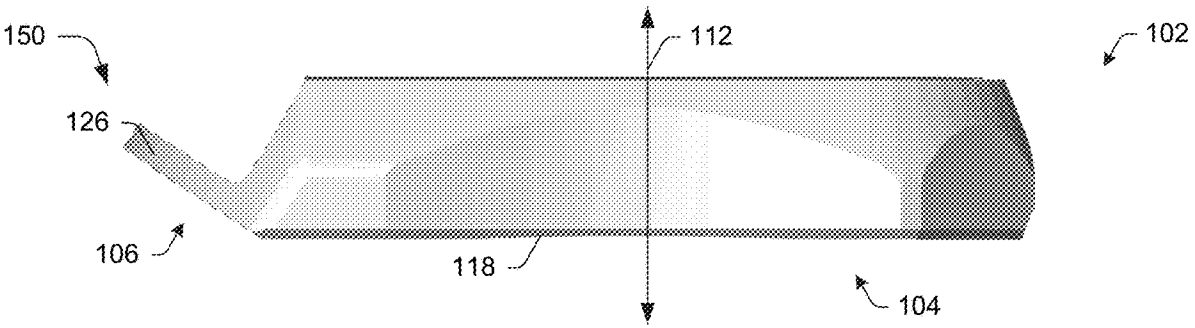
FIG. 1B depicts a side view of the magazine insertion guide.
Figure 1C:
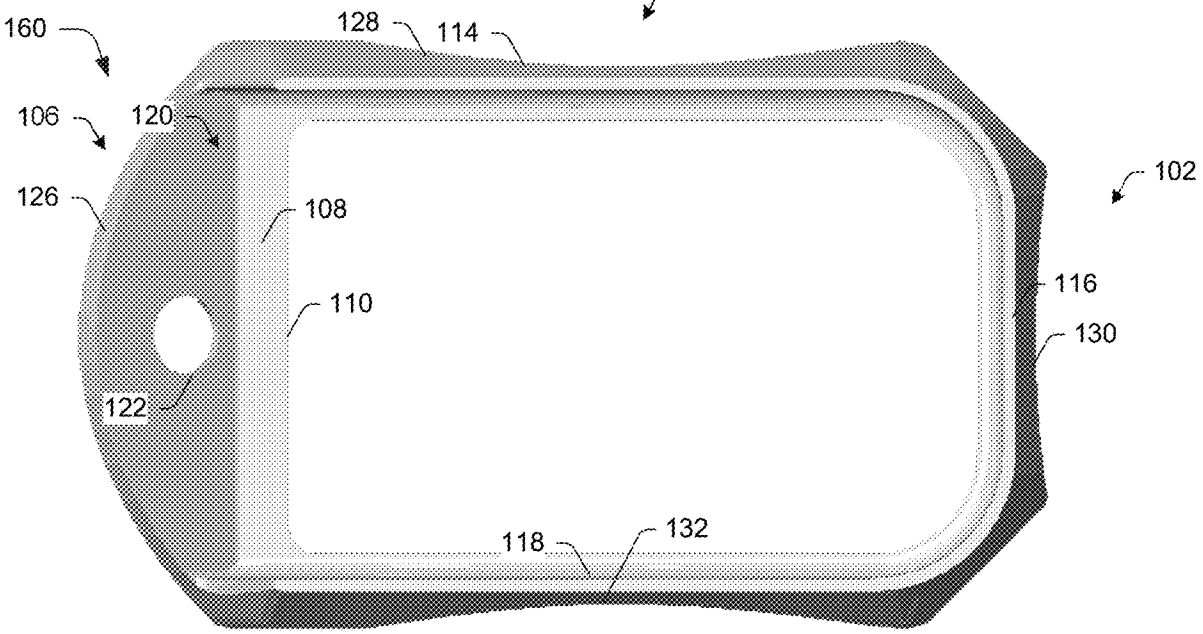
FIG. 1C depicts a top view of the magazine insertion guide as showing an inner cavity within which a pistol grip of a firearm is disposed for attachment.
Figure 1D:
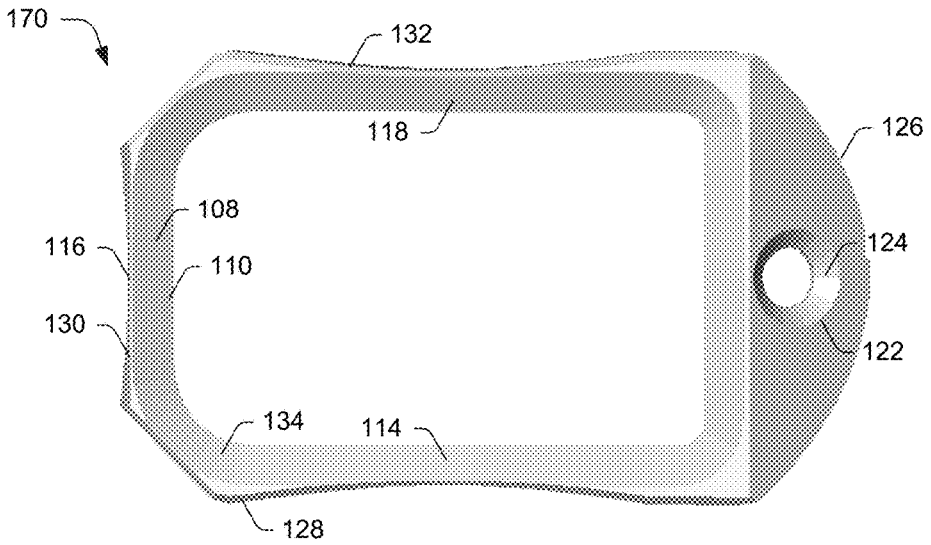
FIG. 1D depicts a bottom view of the magazine insertion guide as showing an outer surface configured to guide a magazine to within an interior of a pistol grip of a firearm.
Figure 1E:
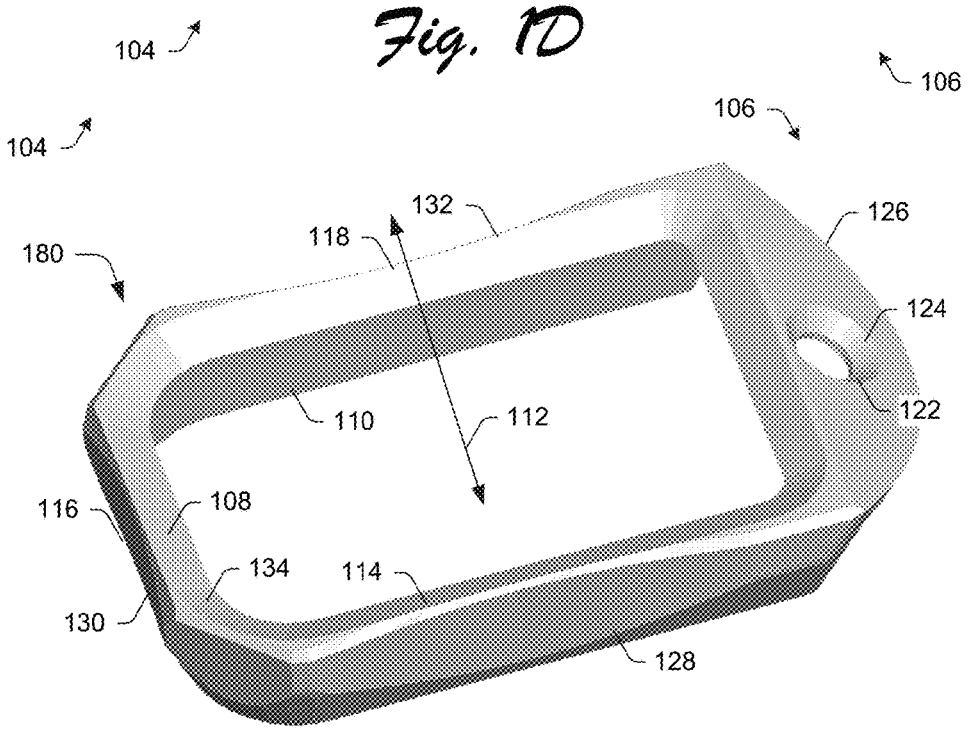
FIG. 1E depicts an isometric view of the magazine insertion guide as showing an outer surface of a bottom of the guide as configured to guide a magazine to within an interior of a pistol grip of a firearm.

FIG. 1A depicts an isometric view 100 from a rearward side of a magazine insertion guide 102. FIG. 1B depicts a side view 150 of the magazine insertion guide 102. FIG. 1C depicts a top view 160 of the magazine insertion guide 102 as showing an inner cavity within which a pistol grip of a firearm is disposed for attachment. FIG. 1D depicts a bottom view 170 of the magazine insertion guide 102 as showing an outer surface configured to guide a magazine to within an interior of a pistol grip of a firearm. FIG. 1E depicts an isometric view 180 of the magazine insertion guide 102 as showing an outer surface of a bottom of the guide as configured to guide a magazine to within an interior of a pistol grip of a firearm. FIG. 1F depicts a rear view 190 of the magazine insertion guide 102. In this portion of the discussion, reference will be made interchangeably to FIGS. 1A-1F.

The magazine insertion guide 102 include a guide portion 104 to guide insertion of a magazine and a securing portion 106 to secure the magazine insertion guide 102 to a firearm, e.g., through use of a screw. The magazine insertion guide 102 is configured for use with different backstraps for a pistol grip of a firearm and has a reduced height to promote use in non-competition environments, e.g., as part of concealed carry. In this way, a single magazine insertion guide 102 may be manufactured and included for a firearm (e.g., pistol) along with a plurality of different backstraps, which is more cost effective and efficient.

Figure 7:
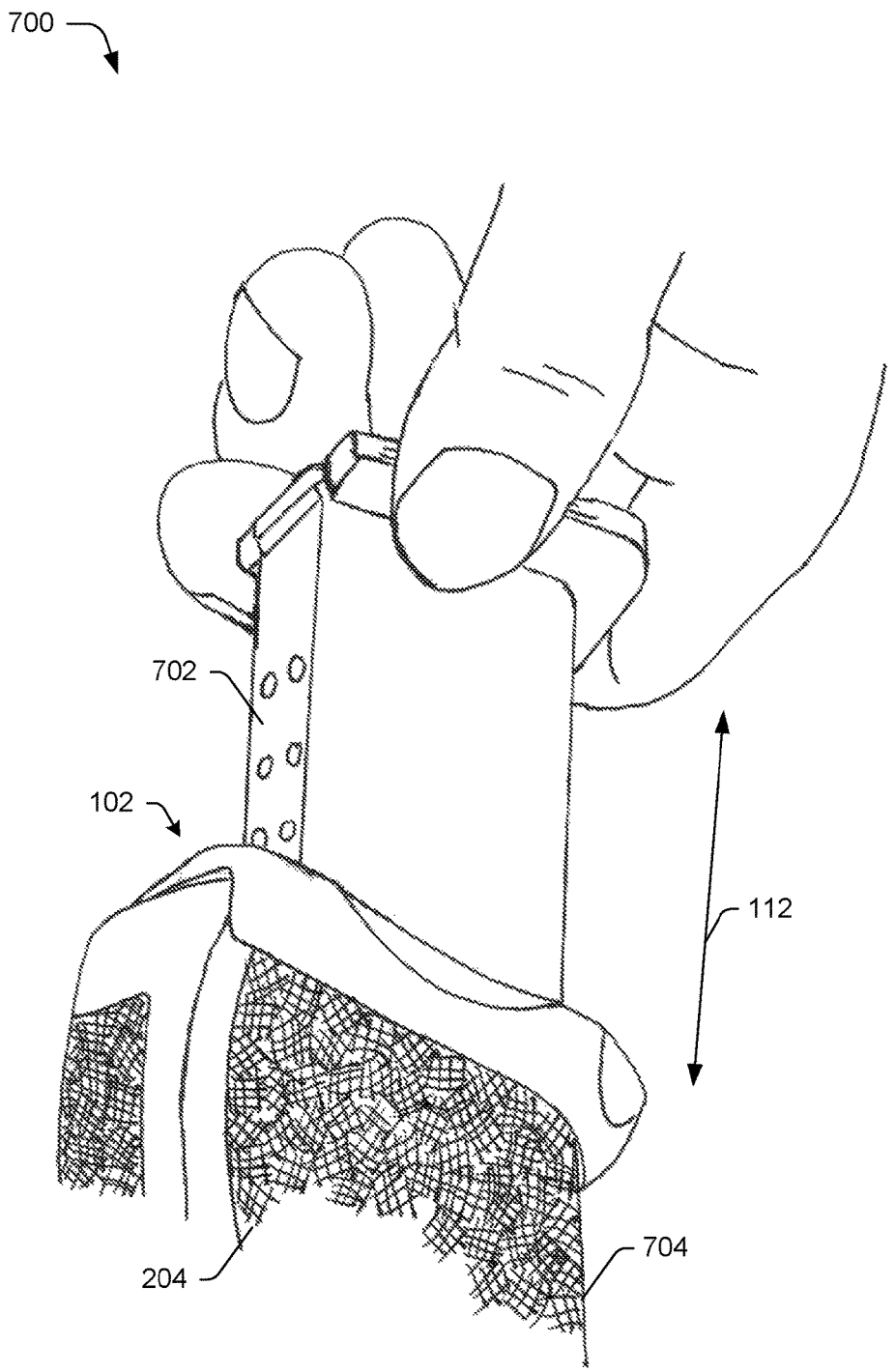
FIGS. 7 and 8 depicts an example implementation showing insertion of a magazine into a pistol grip of a firearm using a magazine insertion guide.
Figure 8:
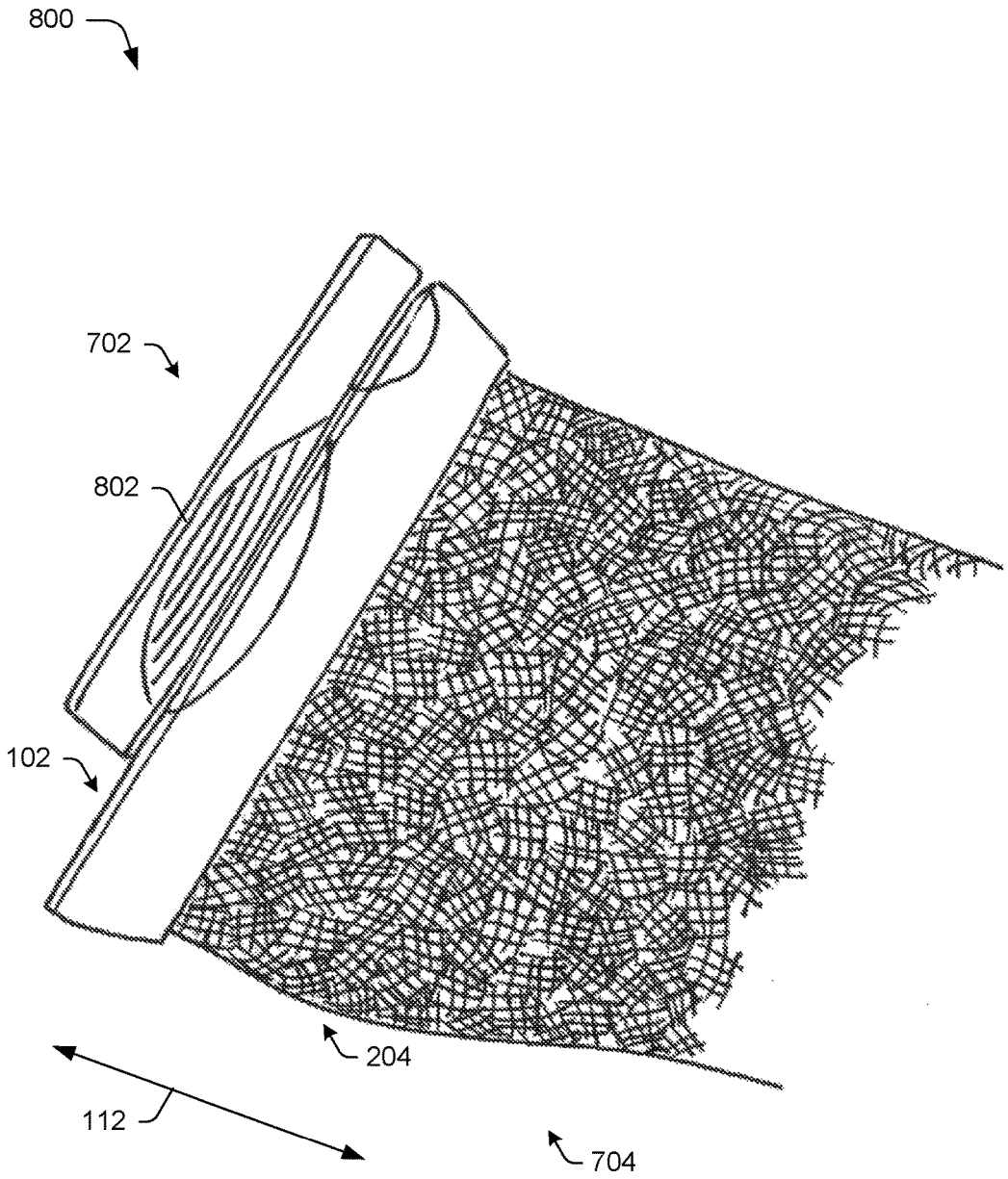
Figure 9:
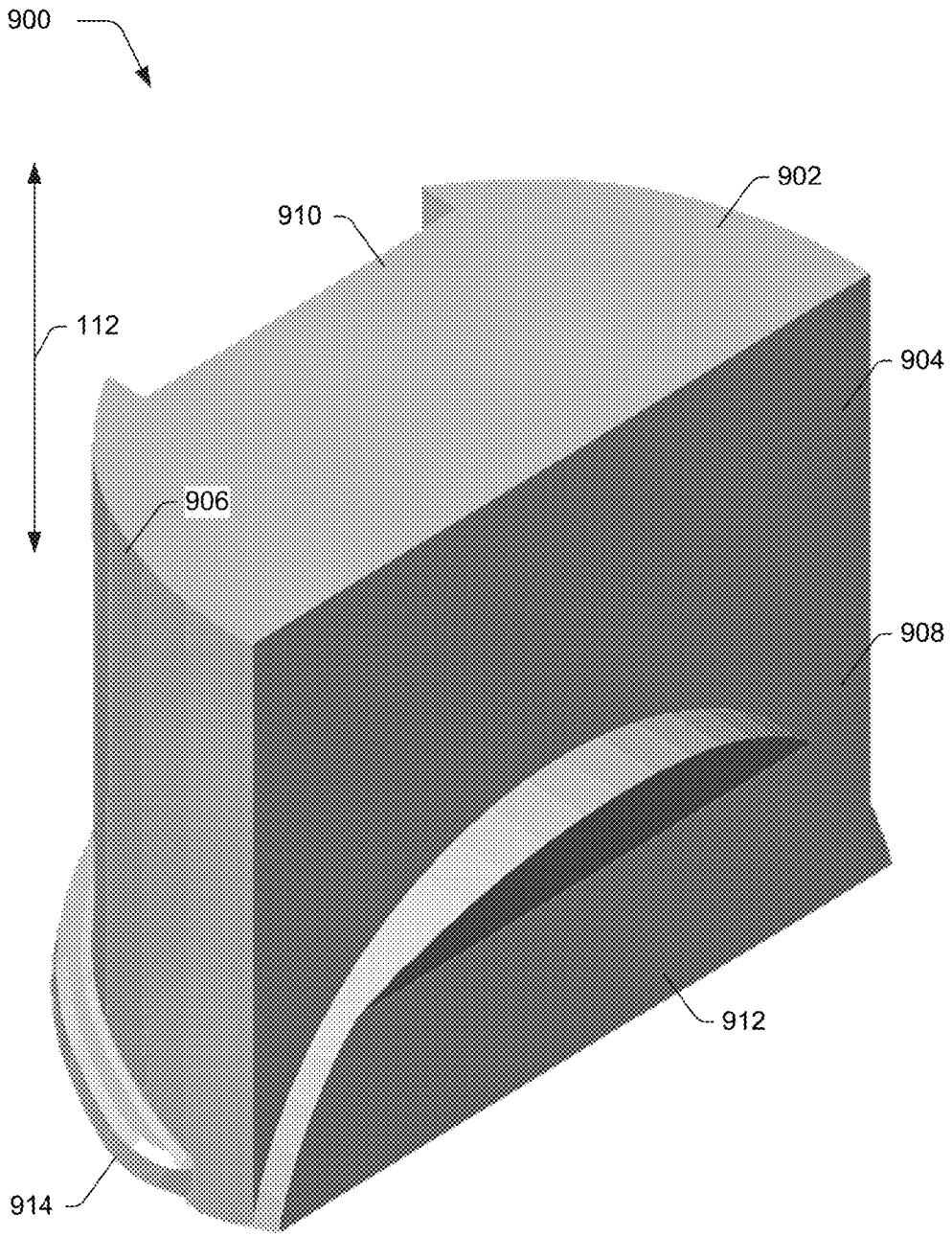
FIGS. 9, 10, 11, 12, 13, 14, 15, and 16 depict example views of a plug used to support attachment of the magazine insertion guide.
Figure 10:
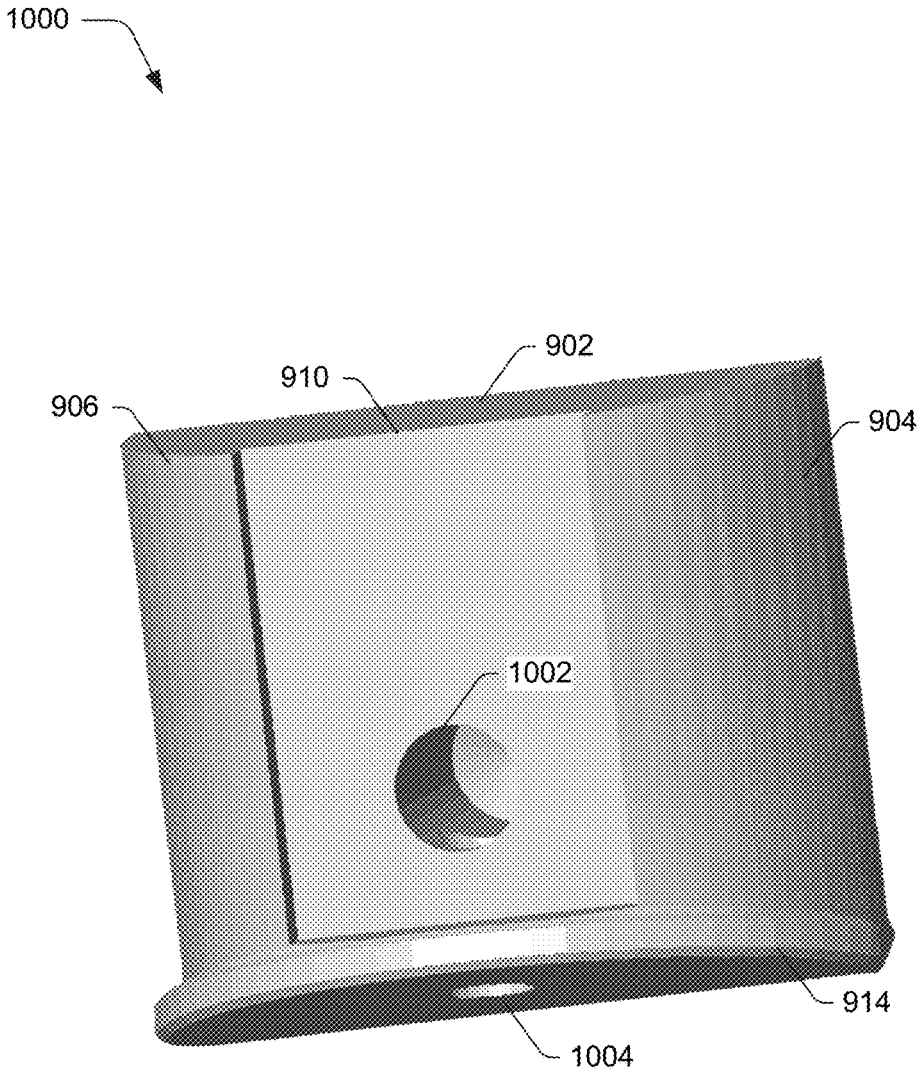

The guide portion 104 includes a floor plate 108 having an aperture 110 formed therein that is configured to permit passage of a magazine of a firearm there through as shown in greater detail in FIGS. 7 and 8. In the illustrated example, the aperture 110 has a generally rounded rectangular shape. The aperture 110 defines a plane in this example that is generally perpendicular to a longitudinal axis 112 that permits insertion and removal of the magazine from the pistol grip.

The guide portion 104 also includes a plurality of sides, including first, second, and third sides 114, 116, 118 that extend generally perpendicular to the floor plate 108 and thus along the longitudinal axis 112. Together, the first, second, and third sides 114, 116, 118 at least partially encompass corresponding sides of a pistol grip of the firearm by defining an inner cavity 120, in which, a portion of the pistol grip is received. An inner surface of the first, second, and third sides 114, 116, 118 is formed to have a complementary shape of the pistol grip, which includes rounded corners and is generally flat in this example.

The plurality of sides (e.g., the first second, and third sides 114, 116, 118) are configured to at least partially surround a frame 1802 of a pistol grip of the firearm 204 but not a backstrap 206 of the firearm 204. Thus, the backstrap 206 may be installed to and removed from the frame 1802 of the pistol grip through an opening 1902 formed by the plurality of sides of the guide portion 104. The opening 1902 is formed as generally perpendicular to the aperture 110. Further, this permits backstraps 206 to be interchanged through the opening 1902 and have different sizes, which is not possible using conventional magazine insertion guides.

Figure 2A:
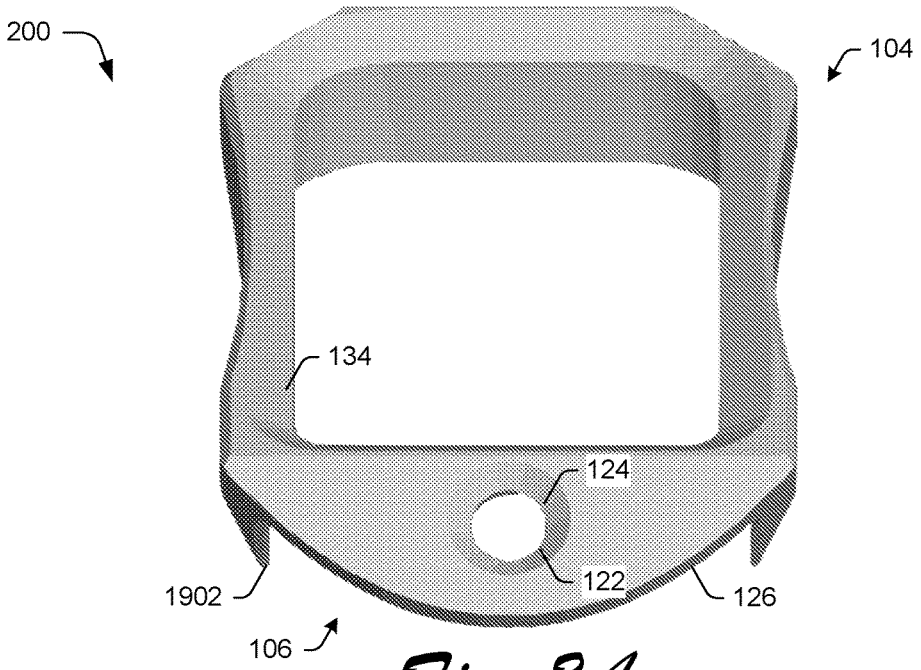
FIG. 2A depicts an isometric view showing a bottom surface of a magazine insertion guide of FIG. 1.
Figure 2B:
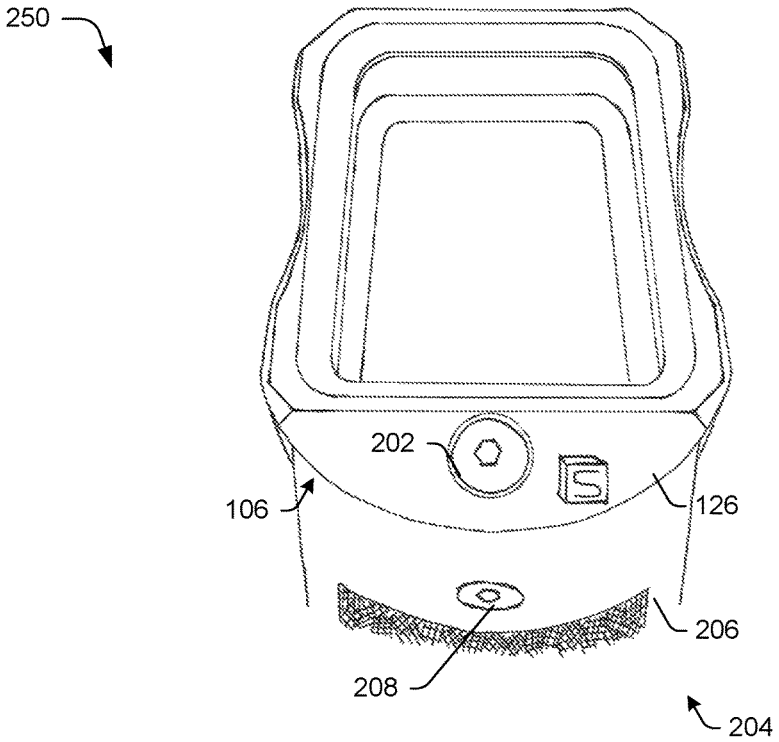
FIG. 2B is an illustration showing the magazine insertion guide as attached to a pistol grip of a firearm.
Figure 3:
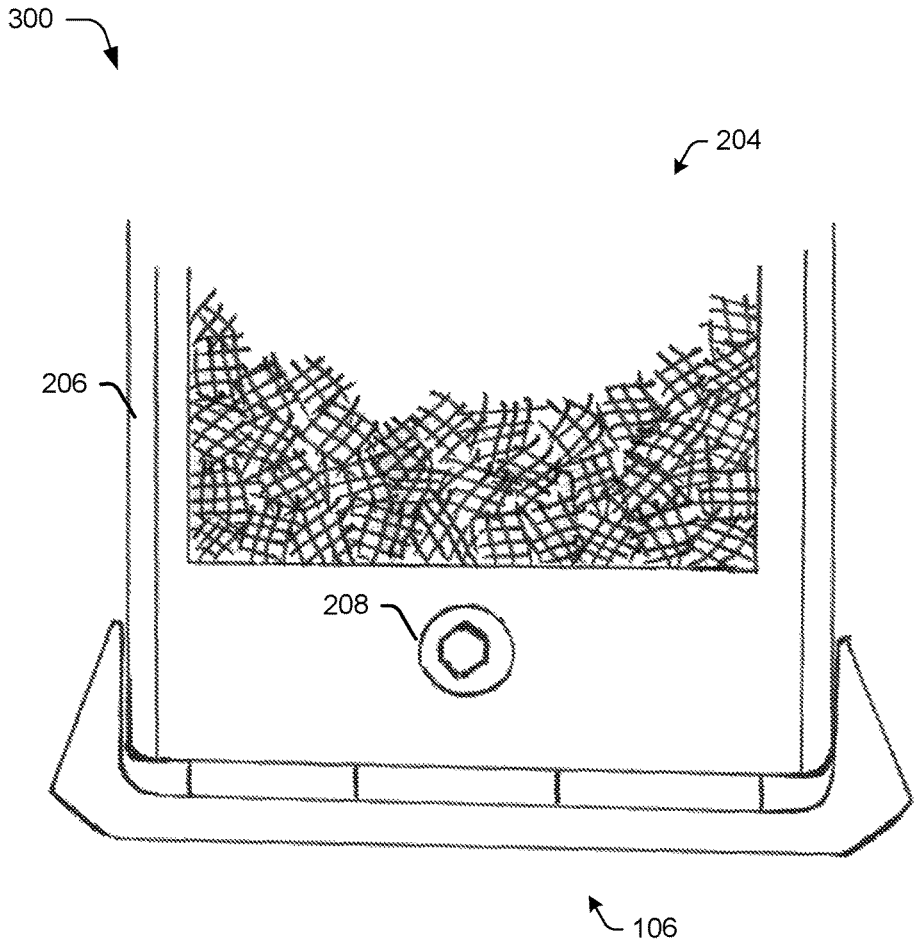
FIGS. 3, 4, 5 and 6 depict additional example implementations of a magazine insertion guide.

The securing portion 106 is configured to secure the magazine insertion guide 102 to the firearm. In the illustrated example, the securing portion 106 includes a hole 122 through which as screw is disposed to attach to a pistol grip of a firearm. The hole 122 includes an outer surface 124 having a complementary shape such that a flush outer surface is formed when the screw 202 is inserted therein, as shown in FIGS. 2A and 2B.

Figure 4:
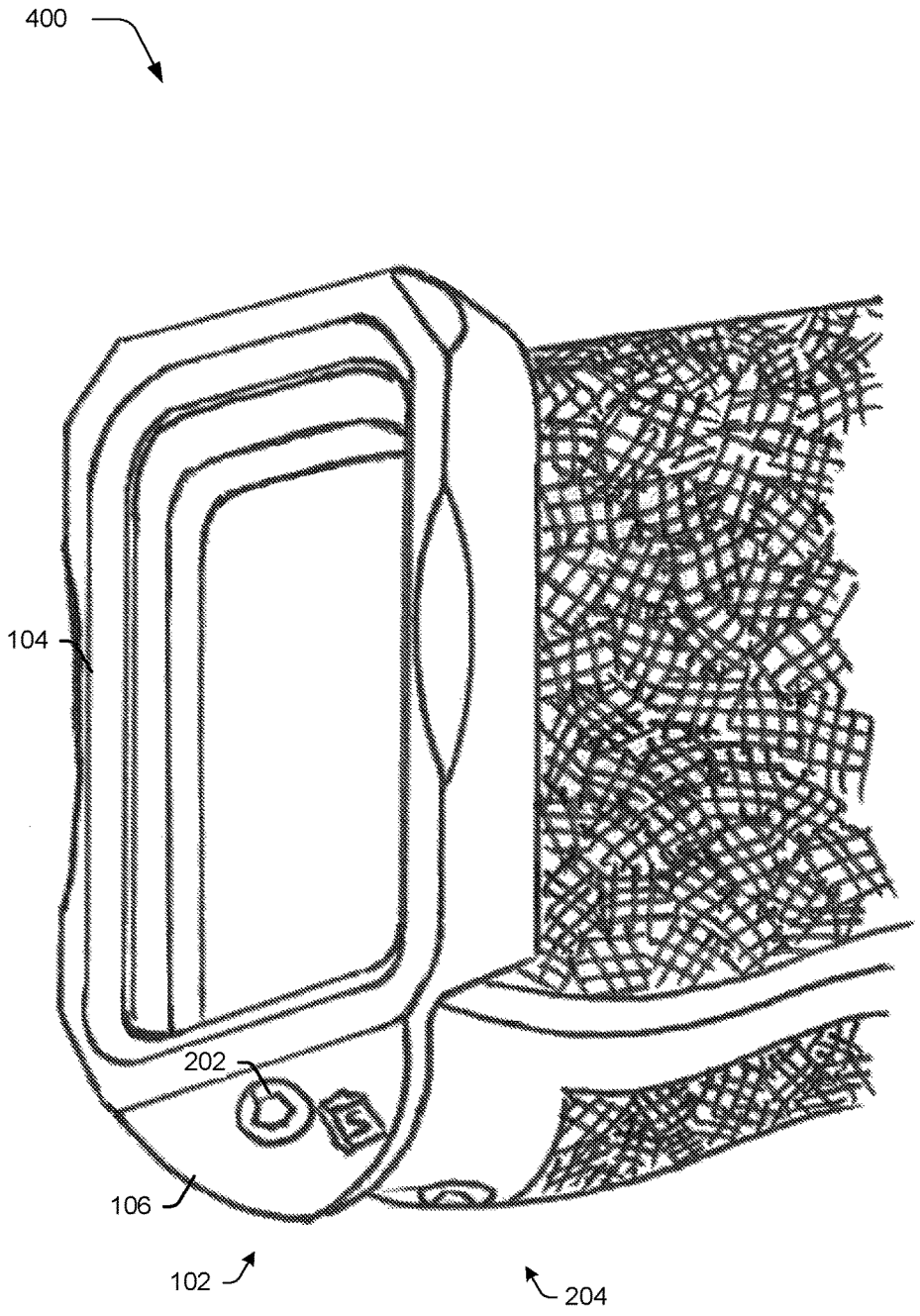
Figure 5:
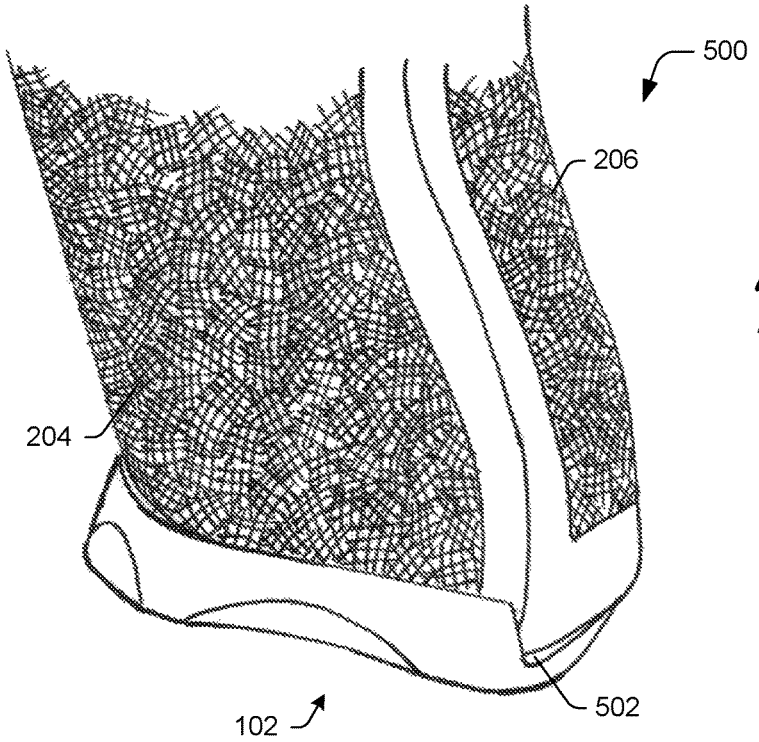
Figure 6:
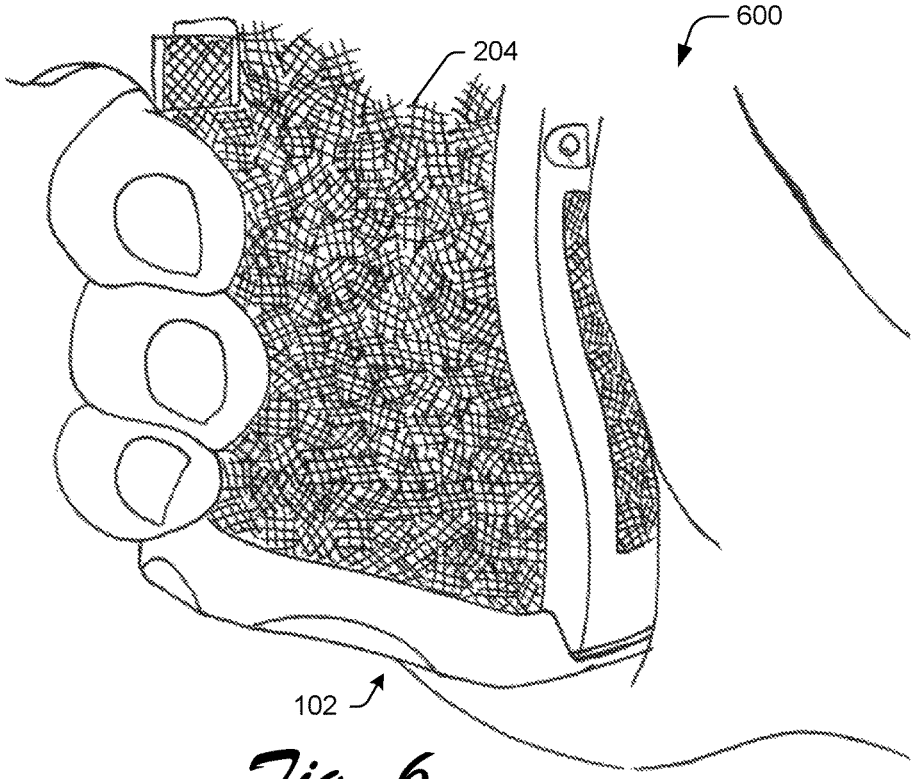

The securing portion 106 in the examples of FIGS. 1A-1F forms an obtuse inner angle 124 as defined within the inner cavity 120 between a plane defined by the floor plate 108 and a surface of the securing portion 106. Other flat examples are also contemplated as shown in FIG. 4. Thus, the securing portion 106 and the floor plate 108 together follow an outer surface and form a complementary shape to that of a lower surface of a pistol grip of a firearm.

The securing portion 106 in this example has a rounded arced surface 126 that is configured to permit attachment and removal of backstraps to the pistol grip of the firearm without removing the magazine insertion guide 102 through the opening 1902. For example, pistols may be configured to include small, medium, and large grip backstraps to comfortably support hands of different sizes, e.g., different heights as defined alone a plane that is perpendicular to the longitudinal axis 112. Conventionally, a magazine insertion guide was specifically configured for each one, which could be wasteful, inefficient, and frustrating. However, the magazine insertion guide 102 described herein is configured to have a complementary shape to a lower rear portion of a backstrap to permit attachment of different size backstraps to the same firearm using the same magazine insertion guide 102. Additional discussion of this feature is described and shown in relation to FIGS. 2A and 2B.

Opposing outer surfaces 128, 130, 132 of the first, second, and third sides 114, 116, 118 are configured to be grasped by a user through use of concave surfaces. For example, a finger and thumb of a hand of a user may freely slide over the surface when inserting a magazine. Thus, this aids quick insertion and removal of the magazine.

An outer surface 134 of the floor plate includes sloped slides and rounded corners in relation to the longitudinal axis 112. This helps to guide a magazine when inserted into the firearm into an inner cavity of the pistol grip. A user, for instance, may grasp a magazine and attempt to insert the magazine 702 into the firearm as shown in FIG. 7. If contact is made with the outer surface 134, this contact follows the slope to cause alignment of the magazine with the interior of the pistol grip, the insertion of which may then continue to attach the magazine to the firearm. Thus, the magazine insertion guide 102 is configured to aid a user in the operation of the firearm.

FIG. 2A depicts an isometric view 200 showing a bottom surface of the magazine insertion guide 102 of FIG. 1. FIG. 2B is an illustration 250 showing the magazine insertion guide 102 as attached to a pistol grip of a firearm 204. As previously described, the securing portion 106 of the magazine insertion guide 102 includes a hole 122 through which as screw is disposed to attach to a pistol grip of a firearm. In this portion of the discussion, reference will be made interchangeably to FIGS. 2A-2B.

The hole 122 includes an outer surface 124 having a complementary shape such that a flush outer surface is formed when the screw 202 is inserted therein. Further, the magazine insertion guide 102 assumes a shape that permits a backstrap 206 of the pistol grip to be interchanged, e.g., to change between small, medium, and large sizes, without removal and may support each size. A user, for instance, may undo a screw 208 that attaches the backstrap to the pistol grip to change as desired. As illustrated, the outer arced surface 126 is configured to follow a radius of the backstrap 206 and thus prevent snagging and promote a generally uniform and continuous surface across the back of the pistol grip.

FIGS. 3, 4, 5, and 6 depict additional example implementations 300, 400, 500, 600 of the magazine insertion guide 102. In this portion of the discussion, reference will be made interchangeably to FIGS. 3-6. In these examples, the securing portion 106 and the guide portion 104 include outer surfaces are coplanar, e.g., formed generally along a single plane. Therefore, in this example a screw 202 used to connect the magazine insertion guide 102 to the firearm 204 follows the longitudinal axis 112, generally. The securing portion 106 includes an indention 502 that forms a complementary shape of the backstrap 206 to permit different sized backstraps to be used with a single magazine insertion guide 102.

FIG. 7 depicts an example implementation 700 showing insertion of a magazine into a pistol grip 704 of a firearm 204 using the magazine insertion guide 102. As illustrated, off axis insertion forces are channeled by the magazine insertion guide 102 to ease insertion of the magazine 702 into the firearm 204.

FIG. 8 depicts an example implementation 800 in which the magazine of FIG. 7 is inserted into the pistol grip of the firearm 204. As illustrated, the magazine insertion guide 102 has a height as extending from a bottom of the pistol grip that still permits a baseplate 802 of the magazine 702 to remain exposed and installed within the firearm without an extension plate, thereby supporting use in concealed carry scenarios.

Figure 17:
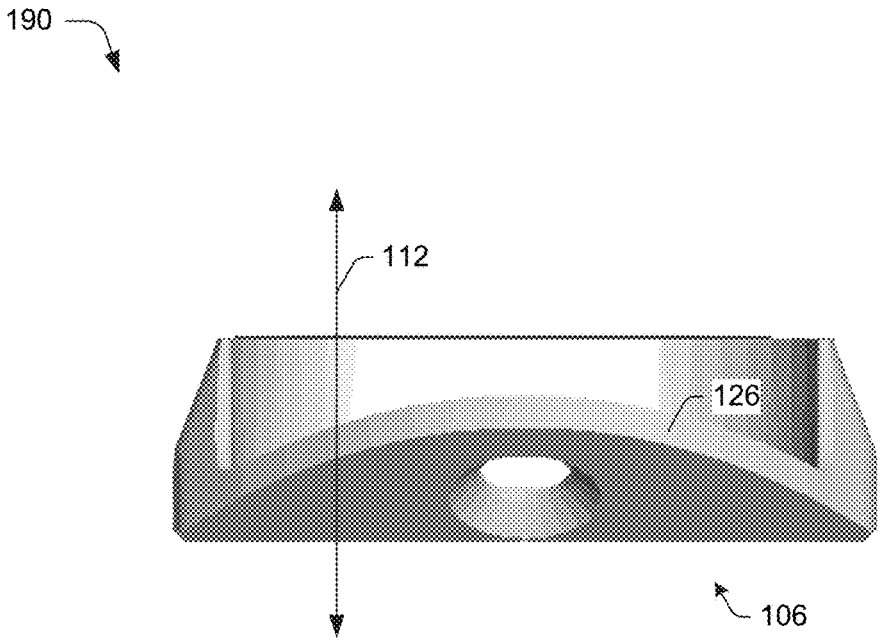
FIG. 17 depicts an example implementation showing the plug and the magazine insertion guide together.
Figure 12:
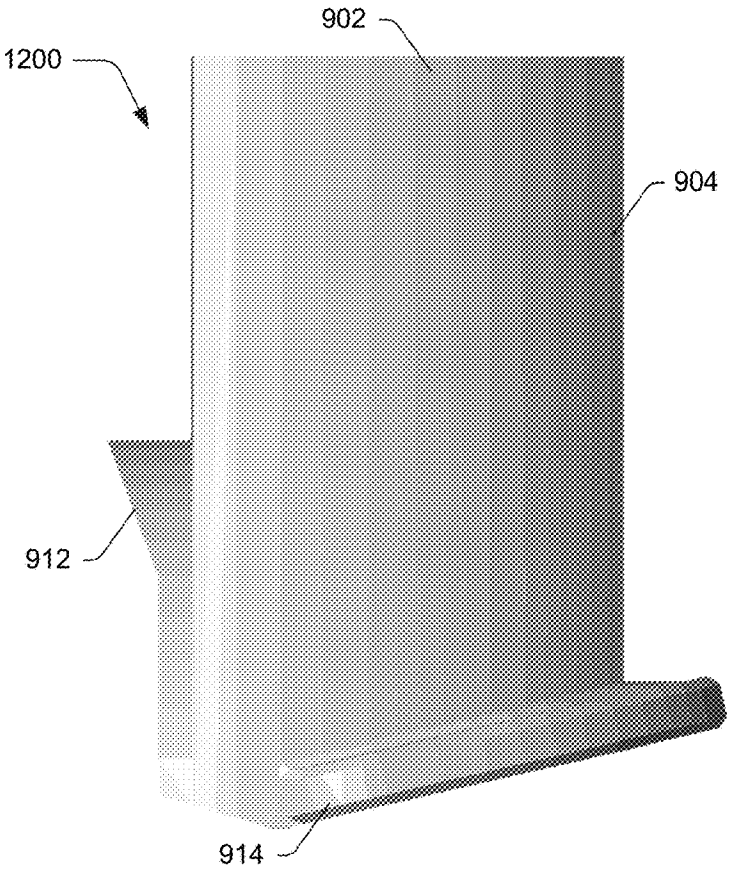
Figure 11:
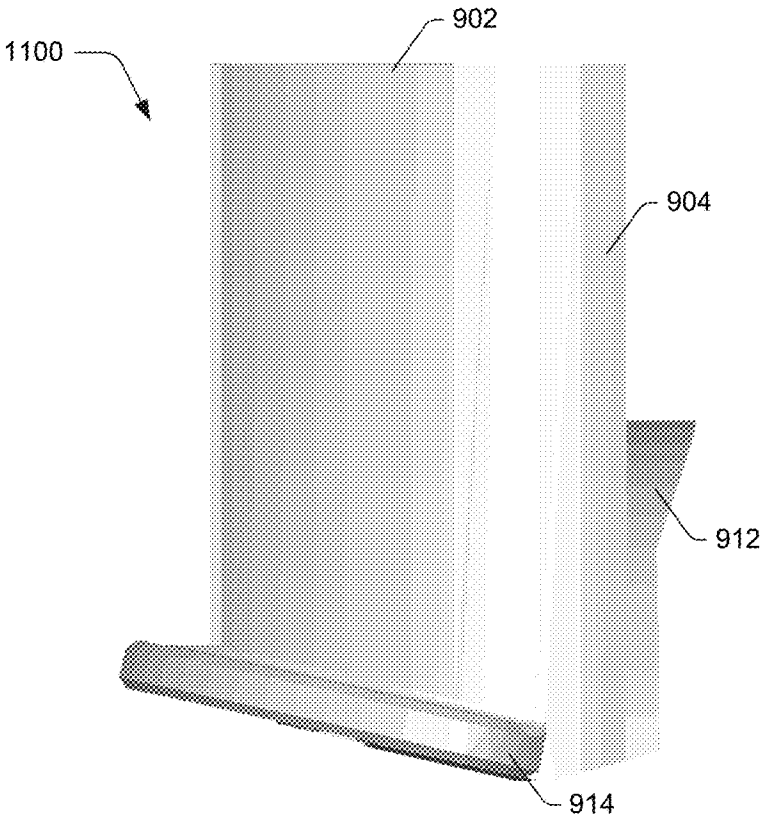
Figure 13:
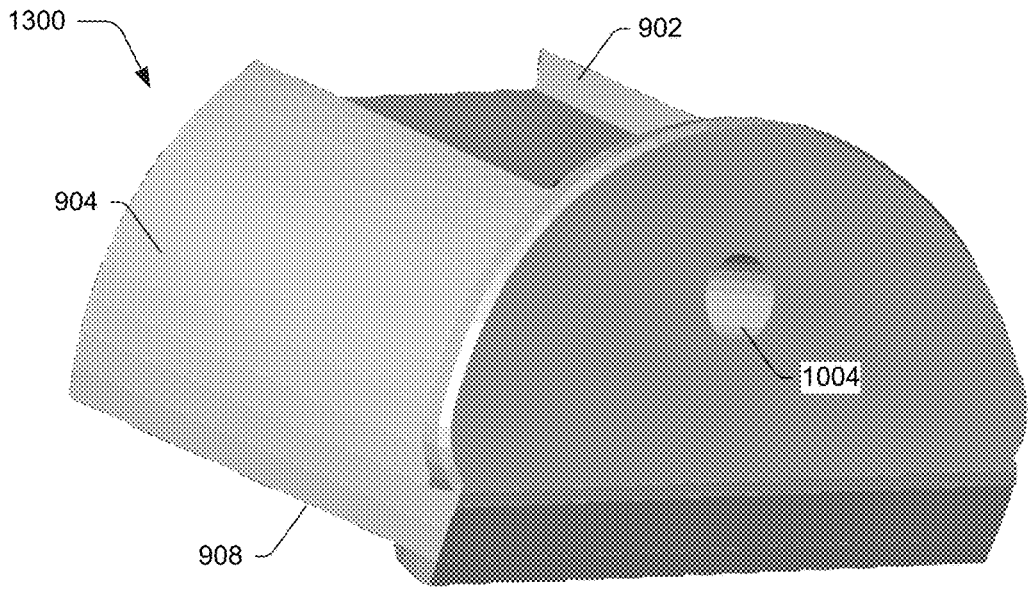
Figure 14:
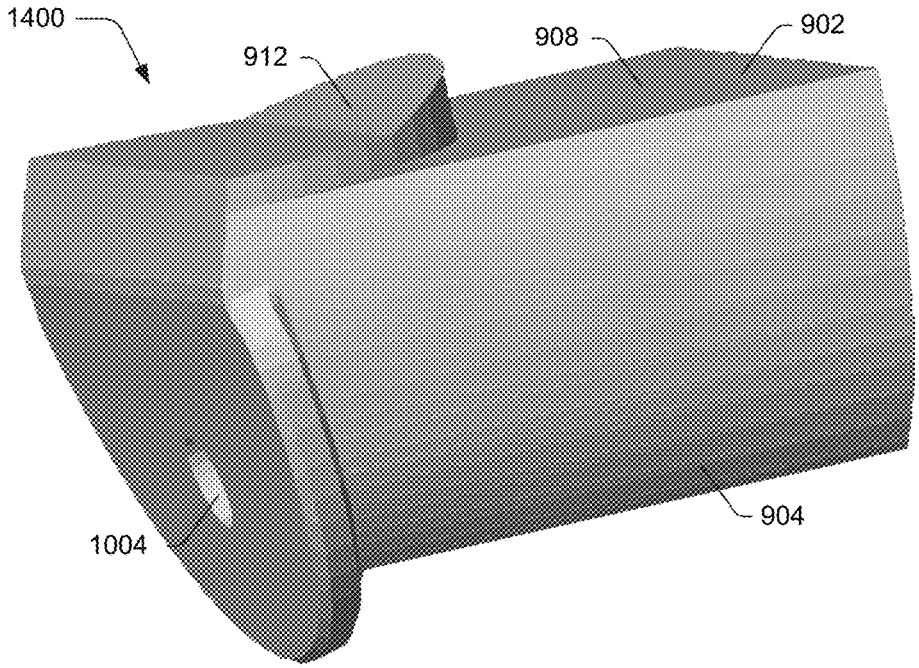
Figure 15:
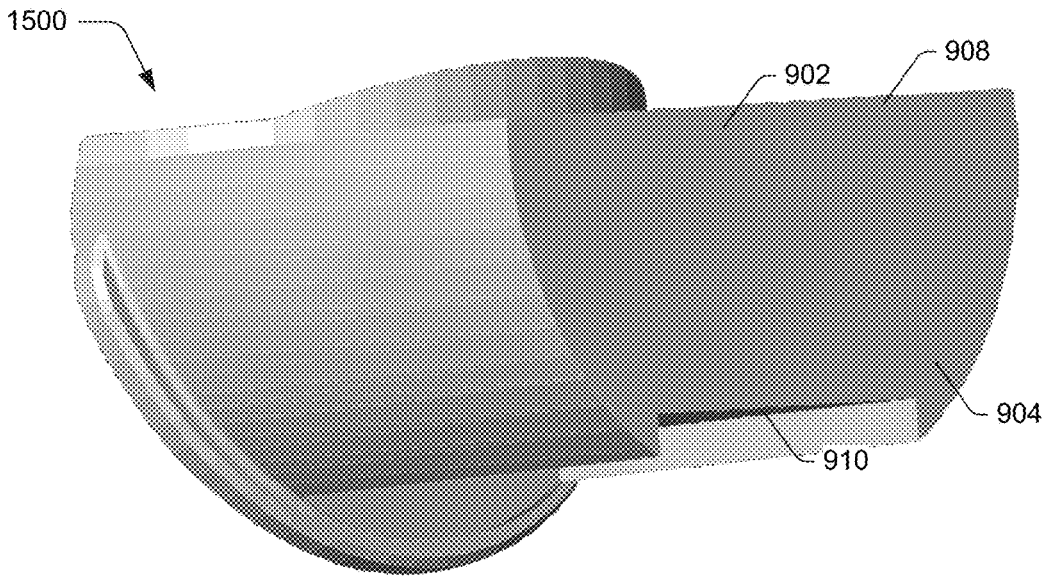
Figure 16:
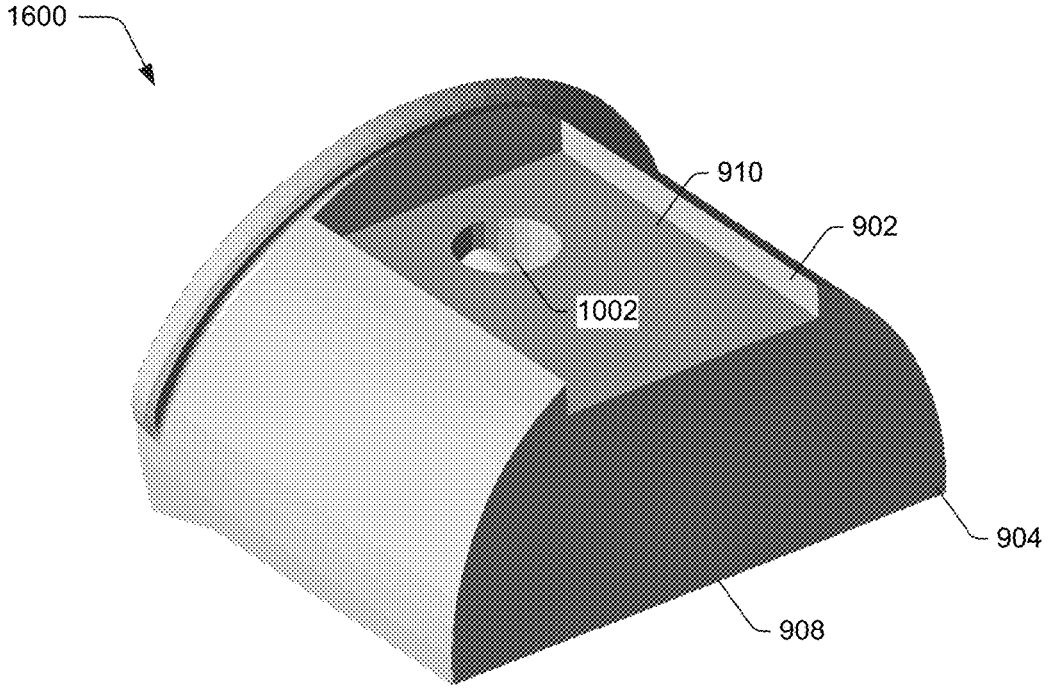
Figure 17:
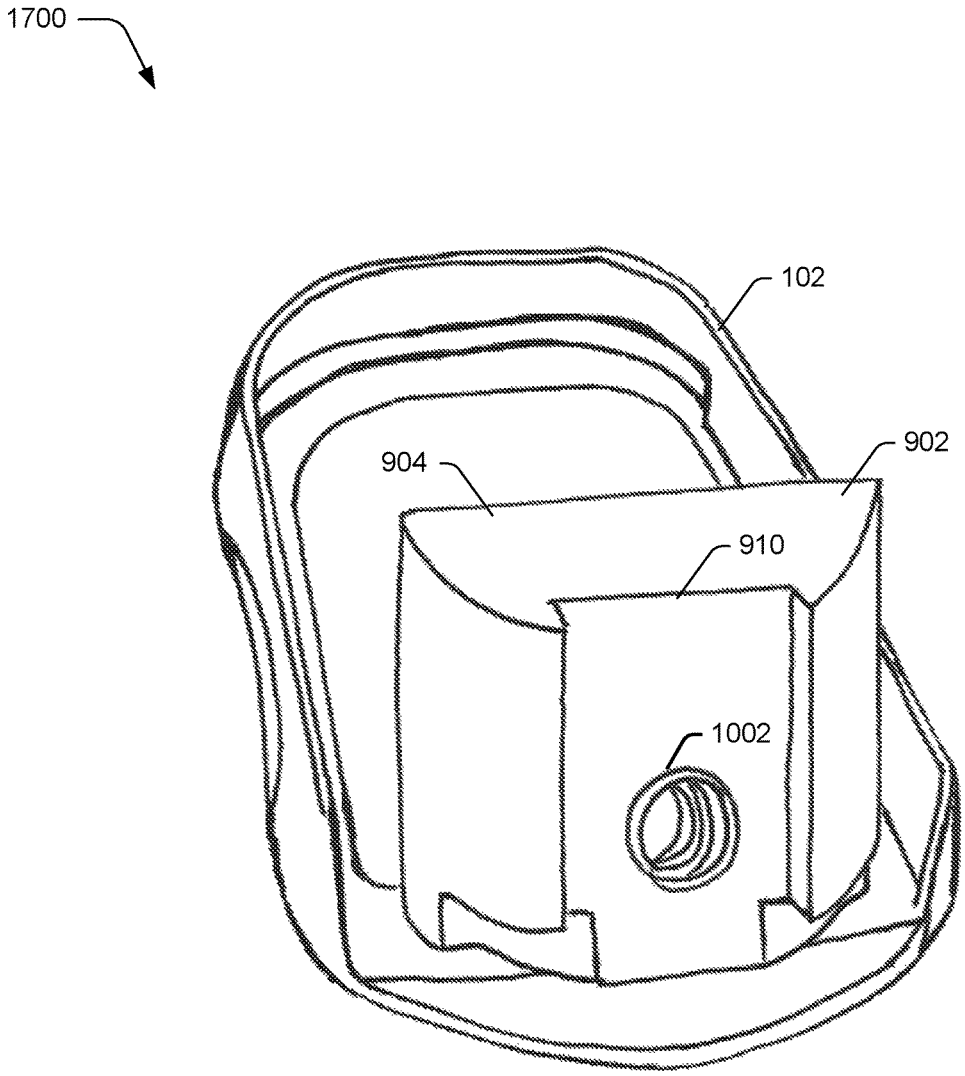
Figure 18:
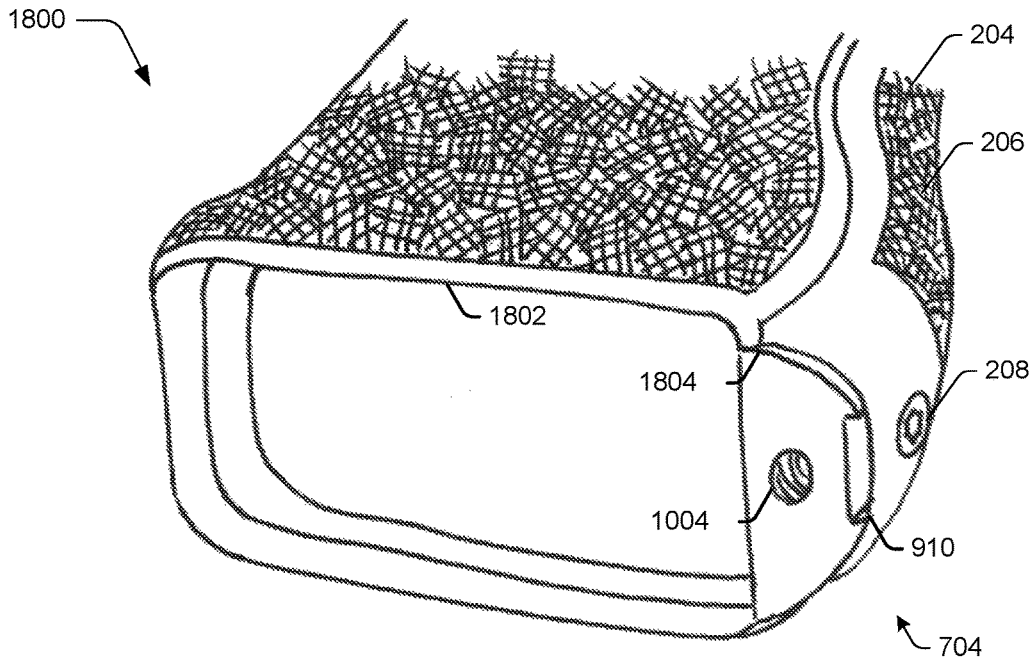
FIG. 18 depicts an example implementation of a firearm showing a plug inserted between the backstrap and a frame of a pistol grip of the firearm.
Figure 19:
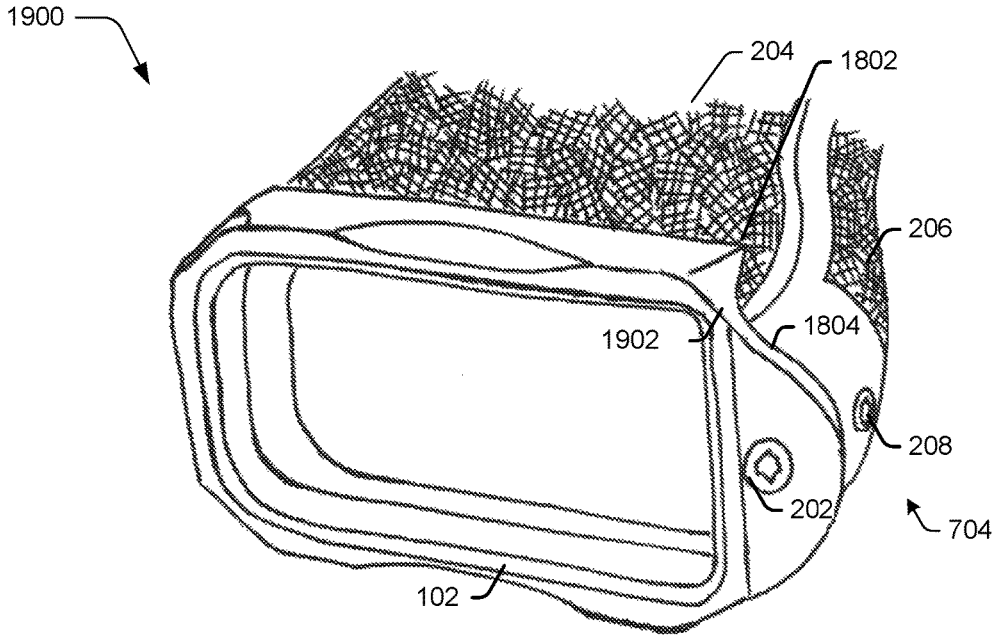
FIG. 19 depicts an example implementation of the magazine insertion guide as installed to the plug and the firearm.

FIGS. 9, 10, 13, 14, 15, and 16 depict example views 900, 1000, 1300, 1400, 1500, 1600 of a plug 902 used to support a backstrap and support attachment of the magazine insertion guide 102. FIGS. 11 and 12 depict example views 1100, 1200 of a plug used for a firearm that does not include a backstrap. FIG. 17 depicts an example implementation 1700 showing the plug 102 and the magazine insertion guide 102 together. FIG. 18 depicts an example implementation 1800 of a firearm 204 showing the plug 902 inserted between the backstrap 206 and a frame 1700 of a pistol grip of the firearm 204. FIG. 19 depicts an example implementation 1900 of the magazine insertion guide 102 as installed to the plug 902 and the firearm 204. In this portion of the discussion, reference will be made interchangeably to FIGS. 9-19.

The plug 902 includes a longitudinal protrusion 904 that is configured to be inserted between a backstrap 206 and a frame 1802 of a pistol grip of the firearm 204 and generally follows the longitudinal axis 112. The longitudinal protrusion 904 includes an outer curved surface 906 as taken along a plane that is perpendicular to the longitudinal axis 112 that is configured to be disposed adjacent to the backstrap 206. The longitudinal protrusion 904 also includes a flat surface 904 as taken along a plane that is perpendicular to the longitudinal axis 112 that is configured to be disposed adjacent to the frame 1802 of the firearm 204.

The outer curved surface 906 include a channel 910 formed therein that is configured to engage a protrusion of the backstrap 206. A snapping portion 912 is also included 914 to cause the plug 902 to "snap into" the frame 1802 of the firearm, thereby security the plug 902 within a cavity 1804 formed between the backstrap 206 and the frame 1802. In this way, a user may insert the plug 902 by "pushing it up into" the cavity 1804 for installation.

The plug 902 also includes a stopping portion 914 that forms an interface between the plug 902 and the backstrap 206. This is used to form a generally continuous surface extending along an open end of the frame 1802, into which, the magazine 702 is to be inserted, and the lower surface of the plug 902.

The plug 902 further includes a backstrap securing receptacle 1002 that is threaded in this example to receive a screw 208 used to secure the backstrap 206 to the firearm 204. The plug 902 also includes a guide receptacle 1004 that is threaded in this example to receive a screw 202 used to secure the magazine insertion guide 102 to the firearm 204.

Figure 20:
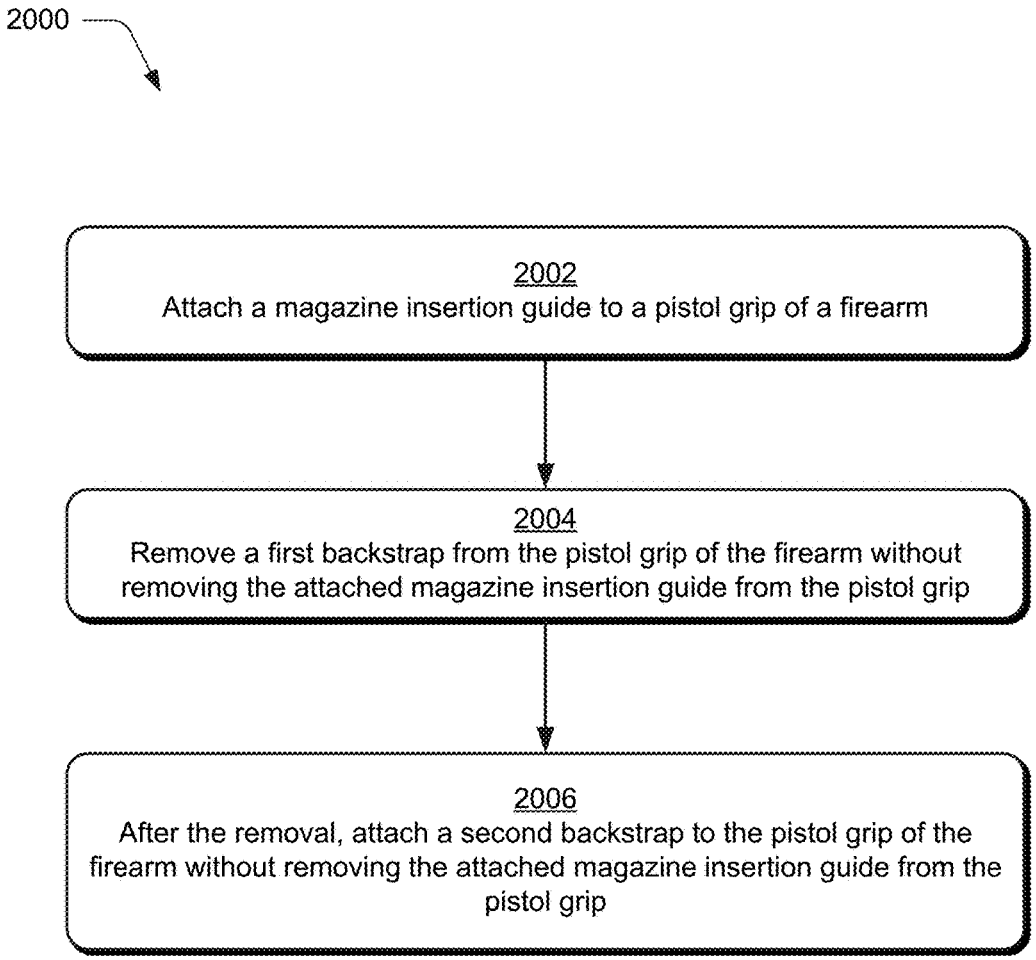
FIG. 20 is a flow chart depicting a method in an example implementation of installation of the magazine insertion guide and interchangeable backstraps.

FIG. 20 depicts a procedure in an example implementation in which backstraps are changed on a pistol grip of a firearm without removing a magazine insertion guide. A magazine insertion guide is attached to a pistol grip of a firearm (block 2002). A first backstrap is removed from the pistol grip of the firearm without removing the attached magazine insertion guide from the pistol grip (block 2004). After the first backstrap is removed, a second backstrap is attached to the pistol grip of the firearm without removing the attached magazine insertion guide form the pistol grip (block 2006).

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A magazine insertion guide comprising:

a securing portion configured to be secured to a pistol grip of a firearm; and a guide portion including:

ramped internal surfaces configured to guide insertion of a magazine into an interior of the pistol grip of the firearm; and a plurality of sides that are configured to at least partially surround the pistol grip of the firearm, a rear side of the plurality of sides having an opening configured to permit installation and removal of a plurality of different sized backstraps when the securing portion is secured to the pistol grip of the firearm and without removal of the securing portion.

2. The magazine insertion guide as described in claim 1, wherein the firearm is a pistol.

3. The magazine insertion guide as described in claim 1, wherein the guide portion include a floor plate having an aperture formed therein that is configured to permit passage of the magazine.

4. The magazine insertion guide as described in claim 3, wherein an outer surface of the floor plate and an outer surface of the securing portion are coplanar.

5. The magazine insertion guide as described in claim 3, wherein an outer surface of the floor plate and an outer surface of the securing portion are not coplanar.

6. The magazine insertion guide as described in claim 1, wherein the securing portion includes an aperture, through which, a screw is configured to be disposed to secure the magazine insertion guide to the firearm.

7. The magazine insertion guide as described in claim 1, wherein the opening is defined along a plane that is generally perpendicular to a longitudinal axis defined to permit insertion and removal of the magazine from the interior of the pistol grip.

8. The magazine insertion guide as described in claim 1, wherein an inner surface of the plurality of sides forms a complementary shape to an outer surface of the pistol grip.

9. A system comprising:

a firearm;

a plurality of backstraps having different sizes, one to another, to support use by different sized hands of a user when attached to a pistol grip of the firearm; and a magazine insertion guide having a securing portion configured to be secured to the pistol grip and a guide portion including ramped internal surfaces configured to guide insertion of a magazine into an interior of the grip of the firearm; and a plurality of sides that are configured to at least partially surround the pistol grip of the firearm, a rear side of the plurality of sides having an opening configured to permit installation and removal of the plurality of different sized backstraps when the securing portion is secured to the pistol grip of the firearm and without removal of the securing portion.

10. The system as described in claim 9, further comprising a plug configured to be disposed in a cavity formed between at least one said backstrap when installed to a frame of the pistol grip of the firearm and the frame.

11. The system as described in claim 10, wherein the plug further includes a backstrap securing receptacle that is configured to receive a screw to secure the at least one said backstrap to the frame.

12. The system as described in claim 10, wherein the plug further includes a guide receptacle that is configured to receive a screw to secure the magazine insertion guide to the frame.

13. The system as described in claim 9, wherein the firearm is a pistol.

14. The system as described in claim 9, wherein the guide portion includes a floor plate having an aperture formed therein that is configured to permit passage of the magazine.

15. The system as described in claim 14, wherein an outer surface of the floor plate and an outer surface of the securing portion are coplanar.

16. The system as described in claim 14, wherein an outer surface of the floor plate and an outer surface of the securing portion are not coplanar.

17. The system as described in claim 9, wherein the opening is defined along a plane that is generally perpendicular to a longitudinal axis defined to permit insertion and removal of the magazine from the interior of the pistol grip.

18. The system as described in claim 9, wherein an inner surface of the plurality of sides forms a complementary shape to an outer surface of the pistol grip.

19. A system comprising:

a firearm;

a plurality of backstraps having different sizes, one to another, to support use by different sized hands of a user when attached to a pistol grip of the firearm; and a magazine insertion guide having:

a securing portion configured to be secured to the pistol grip by an aperture, through which, a screw is configured to be disposed to secure the magazine insertion guide to the firearm; and a guide portion including:

ramped internal surfaces configured to guide insertion of a magazine into an interior of the grip of the firearm; and a plurality of sides that are configured to at least partially surround the pistol grip of the firearm, a rear side of the plurality of sides having an opening configured to permit installation and removal of the plurality of different sized backstraps when the securing portion is secured to the pistol grip of the firearm and without removal of the securing portion.

20. The system of claim 19, further comprising:

a plug configured to be disposed in a cavity formed between at least one said backstrap when installed to a frame of the pistol grip of the firearm and the frame, the plug including a guide receptacle that is configured to receive the screw to secure the magazine insertion guide to the firearm.

* * * * *